US009809347B2

(12) United States Patent
Weissman

(10) Patent No.: US 9,809,347 B2
(45) Date of Patent: Nov. 7, 2017

(54) DISPLAY CARTON

(71) Applicant: COLGATE-PALMOLIVE COMPANY, New York, NY (US)

(72) Inventor: Neal Weissman, New York, NY (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 28 days.

(21) Appl. No.: 14/823,663

(22) Filed: Aug. 11, 2015

(65) Prior Publication Data

US 2017/0043900 A1 Feb. 16, 2017

(51) Int. Cl.

| | |
|---|---|
| ***B65D 5/42*** | (2006.01) |
| ***B65D 5/10*** | (2006.01) |
| ***B65D 85/14*** | (2006.01) |
| ***B65D 5/56*** | (2006.01) |
| ***B65D 5/48*** | (2006.01) |

(52) U.S. Cl.

CPC ..... *B65D 5/4216* (2013.01); *B65D 5/106* (2013.01); *B65D 5/422* (2013.01); *B65D 5/4204* (2013.01); *B65D 5/4266* (2013.01); *B65D 5/48014* (2013.01); *B65D 5/56* (2013.01); *B65D 85/14* (2013.01)

(58) Field of Classification Search

CPC .... B65D 5/4216; B65D 5/106; B65D 5/4204; B65D 5/4266; B65D 5/56; B65D 85/14; B65D 5/48014; B65D 5/029; B65D 2571/00845; B65D 85/36; B65D 5/2052; B65D 5/6602

USPC ..... 229/116.1, 87.19, 922, 120.18, 162.7, 229/120.12, 162.1, 162.3, 120.08, 145; 206/736, 457, 783; D9/418; 220/376

See application file for complete search history.

(56) References Cited

U.S. PATENT DOCUMENTS

| | | | | |
|---|---|---|---|---|
| 2,074,477 A | | 3/1937 | Kondolf | |
| 2,643,811 A | * | 6/1953 | Bolding | B65D 5/4204 229/120.12 |
| 2,913,101 A | * | 11/1959 | Daily | B65D 5/4204 206/216 |
| 3,147,856 A | | 9/1964 | Lightner et al. | |
| 3,680,687 A | * | 8/1972 | D'Alessio | B65D 5/5016 206/783 |
| 5,607,058 A | * | 3/1997 | Huesman | B65D 5/4204 206/581 |
| 6,530,480 B1 | | 3/2003 | Hardy | |
| 2007/0199982 A1 | | 8/2007 | Lo Duca | |

(Continued)

FOREIGN PATENT DOCUMENTS

| | | |
|---|---|---|
| DE | 2241325 | 2/1974 |
| EP | 1219542 | 7/2002 |

OTHER PUBLICATIONS

International Search Report and Written Opinion for priority PCT application No. PCT/US2016/045370, dated Oct. 27, 2016.

*Primary Examiner* — Christopher Demeree

(57) ABSTRACT

A carton for storing a product can include a plurality of panels, including a plurality of major panels and at least one display panel that at least partially define a product storage space. The carton can further include a cutout or window in one or more of the major panels, and a presentation area on a surface of the display panel. After the carton is sealed, the presentation area is visible through the cutout. The display panel may be positioned between the product storage space and the cutout.

17 Claims, 6 Drawing Sheets

(56) References Cited

U.S. PATENT DOCUMENTS

2013/0001126 A1* 1/2013 Gu ..... B65D 5/5016
206/775

* cited by examiner

DISPLAY CARTON

BACKGROUND

Packaging such as a cardboard or plastic carton is often used for the transport, storage, and display of carton contents, such as a toothpaste tube. The packaging also may include text that identifies the product brand and provides other information such as instructions for use and product ingredients. The appearance of the carton is designed, in part, to draw a potential customer's attention and interest to the product during display. The exterior of the carton may include printed graphics in an attempt to make the packaged product more visually appealing to a potential customer.

A carton design that enhances the visual appearance of the packaging would be desirable.

BRIEF SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

In an embodiment, a carton for storing a product can include a plurality of panels including a plurality of major panels and at least one display panel that at least partially define a product storage space, at least one cutout in at least one of the major panels, and a presentation area on a surface of the display panel. The carton may be configured such that the presentation area is visible through the at least one cutout after the carton is formed. The display panel may be positioned between the product storage space and the cutout.

In another embodiment, a package can include a carton for storing a product. The carton may include a plurality of major panels, wherein the plurality of major panels includes a first major panel comprising a cutout, a display panel, and a presentation area on a surface of the display panel. The presentation area may be visible through the cutout. The package may further include a product sealed within the carton, wherein the display panel is positioned between the product and the cutout.

BRIEF DESCRIPTION OF THE DRAWINGS

The accompanying drawings, which are incorporated in and constitute a part of this specification, illustrate embodiments of the present teachings and together with the description, serve to explain the principles of the disclosure. The present teachings will become more fully understood from the detailed description and the accompanying drawings, wherein.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts. The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

As discussed above, a carton for shipping, storing, and displaying a product such as a toothpaste tube can have an exterior that is printed with graphics to enhance the appearance of the carton in an attempt to draw a potential customer's attention and interest. The present teachings can include a carton having one or more openings in one or more exterior surfaces, and one or more display panels that are visible through the one or more openings. The display panel may have a display item attached thereto or printed thereon. The display item may be printed text and/or graphics, or an item such as a toy, sticker, etc., attached to the display panel with an adhesive or a mechanical attachment such as a staple, twist tie, or strap. The display item may also include a combination of printed text and/or graphics and an item attached to the display panel. The display panel may provide an interesting and attractive visual carton element. In an embodiment, the display panel may have a printed graphic or an attached holographic image that appears to be a toothpaste tube, such as the toothpaste tube that is packaged, or will be packaged, within.

Figure 1:
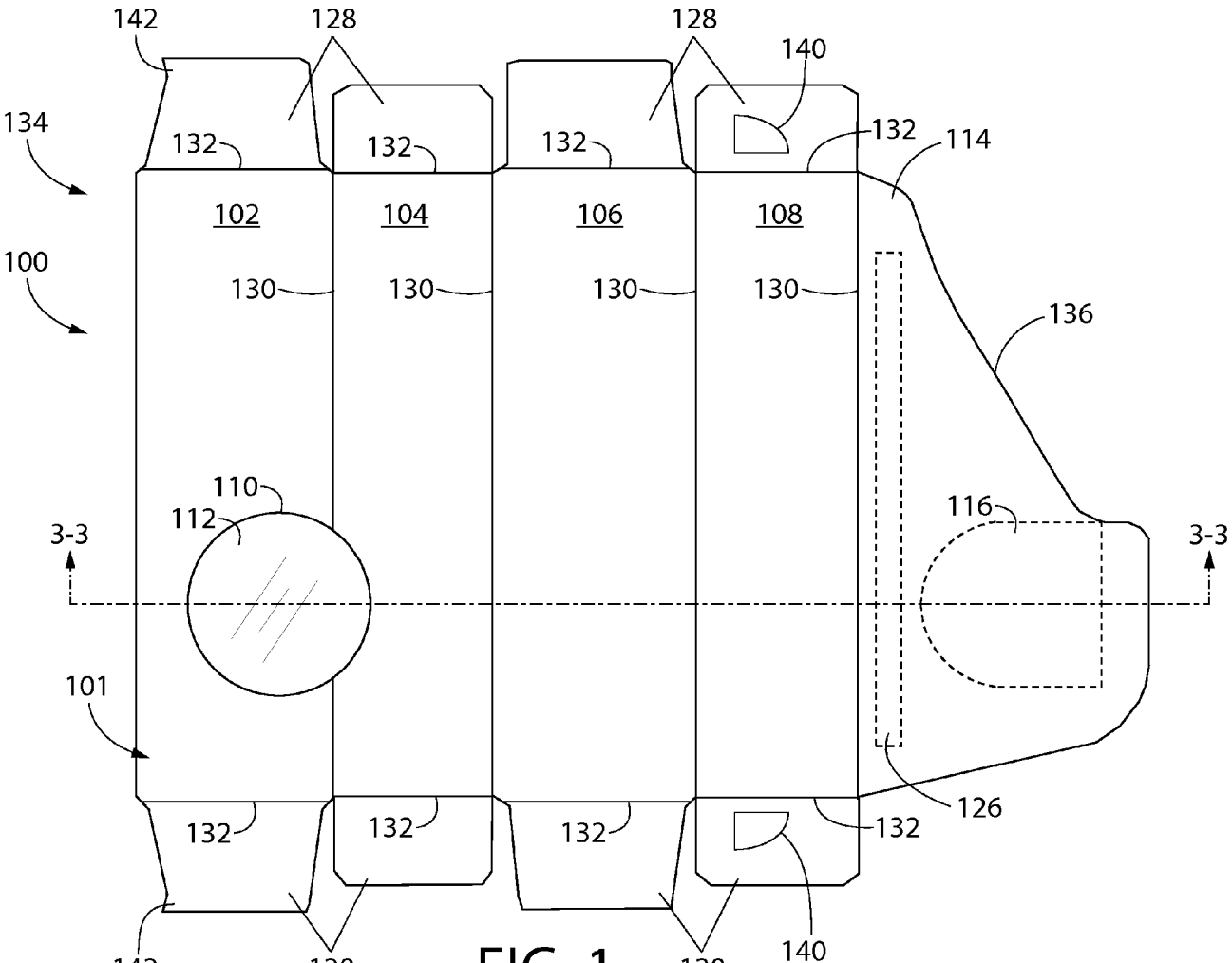
FIG. 1 is a plan view of a display side of a carton in accordance with an embodiment of the present teachings
Figure 2:
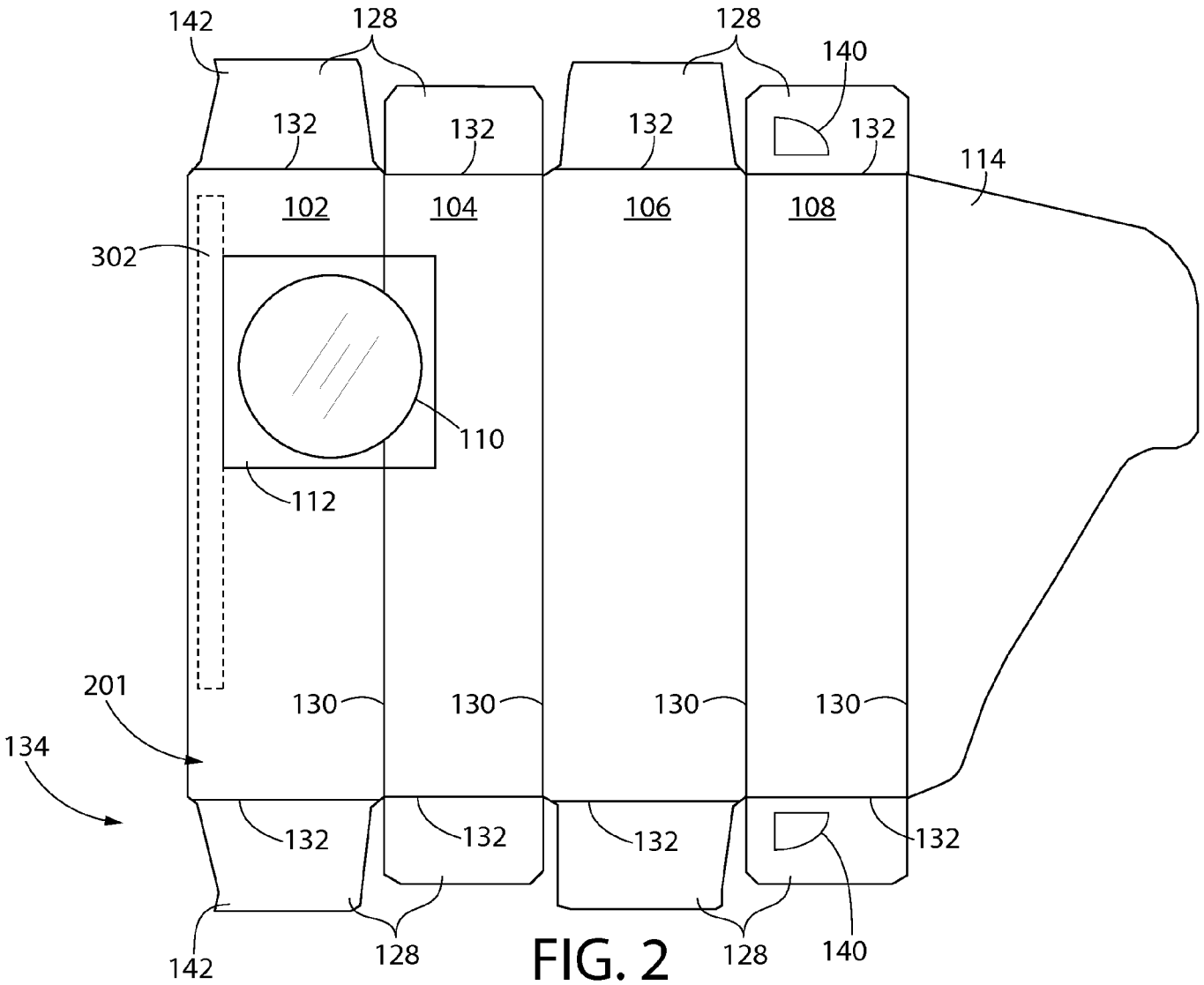
FIG. 2 is a plan view of a reverse side of the carton of FIG. 1, wherein the structure of FIG. 1 is flipped, top to bottom.

FIG. 1 is a plan view depicting a display side 101, and FIG. 2 is a plan view depicting a reverse or internal side 201, of a carton 100 according to an embodiment. In FIGS. 1 and 2, the carton 100 is a flat, unfolded, and unassembled carton according to an embodiment. In the FIG. 2 depiction, the carton 100 has been vertically flipped relative to the FIG. 1 depiction in order to show the reverse side 201 of the FIG. 1 depiction. While the display side 101 may include one or more display items that are visible during display of the carton 100, the reverse side 201 may also include printed text and/or graphics that are viewable after opening the carton 100 (not individually depicted in FIGS. 1 and 2 for simplicity).

The carton 100 of FIG. 1 may include four major panels, including a first major panel 102, a second major panel 104, a third major panel 106, and a fourth major panel 108. The display side 101 of the four major panels 102-108 may be visible after assembly of the carton 100 unless, for example, covered by a sleeve, decal, shrink wrap, etc. The first major panel 102 and, optionally, the second major panel 104 can include at least one cutout or window 110 which is formed by removing the carton material from the window area. The cutout 110 may be optionally covered by a transparent film 112, such as a polymer film, that is bonded to the reverse side 201 of at least the second major panel 104 using an adhesive (not individually depicted for simplicity). The transparent film 112 may prevent tampering with the display item. Other embodiments that omit the transparent film 112 are contemplated, for example, to encourage manipulation of a display item to provide a tactile experience to a potential consumer. While the depicted cutout 110 of FIGS. 1 and 2 is formed on two panels, it will be understood that the cutout 110 may extend across only one panel or more than two panels. Further, while FIGS. 1 and 2 depict a single cutout 110, it will be understood that a carton 100 can include two or more cutouts.

The carton 100 can further include a display panel 114 that is at least partially visible after assembly of the carton 100. In particular, a presentation area 116 of the display panel 114 may be visible through the cutout 110 as described below after assembly of the carton 100. In an embodiment, a display item (300, FIG. 3) within the presentation area 116 is visible through the cutout 110 in the assembled carton 100 as described in more detail below.

The display panel 114, and other major panels 102-108 as desired, can include one or more adhesive receiving areas 126 where an adhesive 302 (FIG. 3), such as a glue, a pressure-sensitive adhesive, or another adhesive, may be placed to bond the carton together during assembly and use. A carton 100 may include other adhesive receiving areas to ensure secure assembly of the carton.

Additionally, the carton 100 can include a plurality of end flaps 128 on either end of the carton 100 that may be used to seal the product within the assembled carton 100. In use, the end flaps 128 may be bonded together using, for example, a bonding agent in accordance with known techniques.

The carton 100 may be at least partially formed from a cellulosic material such as cardboard, a synthetic material such as plastic or another polymer, or a combination thereof. The carton 100 may be a single ply material or a laminated material. As depicted in FIGS. 1 and 2, the carton 100 can be a continuous, single piece of material, and may optionally include the transparent film 112 attached thereto.

The carton 100 can be cut into a desired shape from a blank sheet using any sufficient cutting process, such as blade cutting process, a laser cutting process, a die cutting process, etc. If a transparent film 112 is used to cover the cutout, the transparent film 112 may be attached to the reverse side 201 of the carton 100, for example after formation of the cutout 110 and prior to assembly of the carton 100.

During formation of the carton 100, a plurality of major fold lines 130 and end flap fold lines 132 may be optionally formed, for example using a pre-folding process known in the art. Each major fold line 130 may, in part, define at least one panel of the major panels 102-108 and the display panel 114. Each major fold line 130 may also separate each of the major panels 102-108 and the display panel 114 from an adjacent major panel 102-108 or display panel 114. Each end flap fold line 132 may separate one of the plurality of end flaps 128 from one of the major panels 102-108.

Text and/or graphics may be placed onto either the display side 101 or the reverse side 201 of the blank prior to cutting, or onto the carton 100 after cutting.

During formation, the carton 100 may be folded along the major fold lines 130 such that the display side 101 of each of the four major panels 102-108 is visible. Thus the reverse side 201 of each panel 102-108, 114 forms an angle of approximately 90° with the reverse side 201 of one or two adjacent panels.

Figure 3:
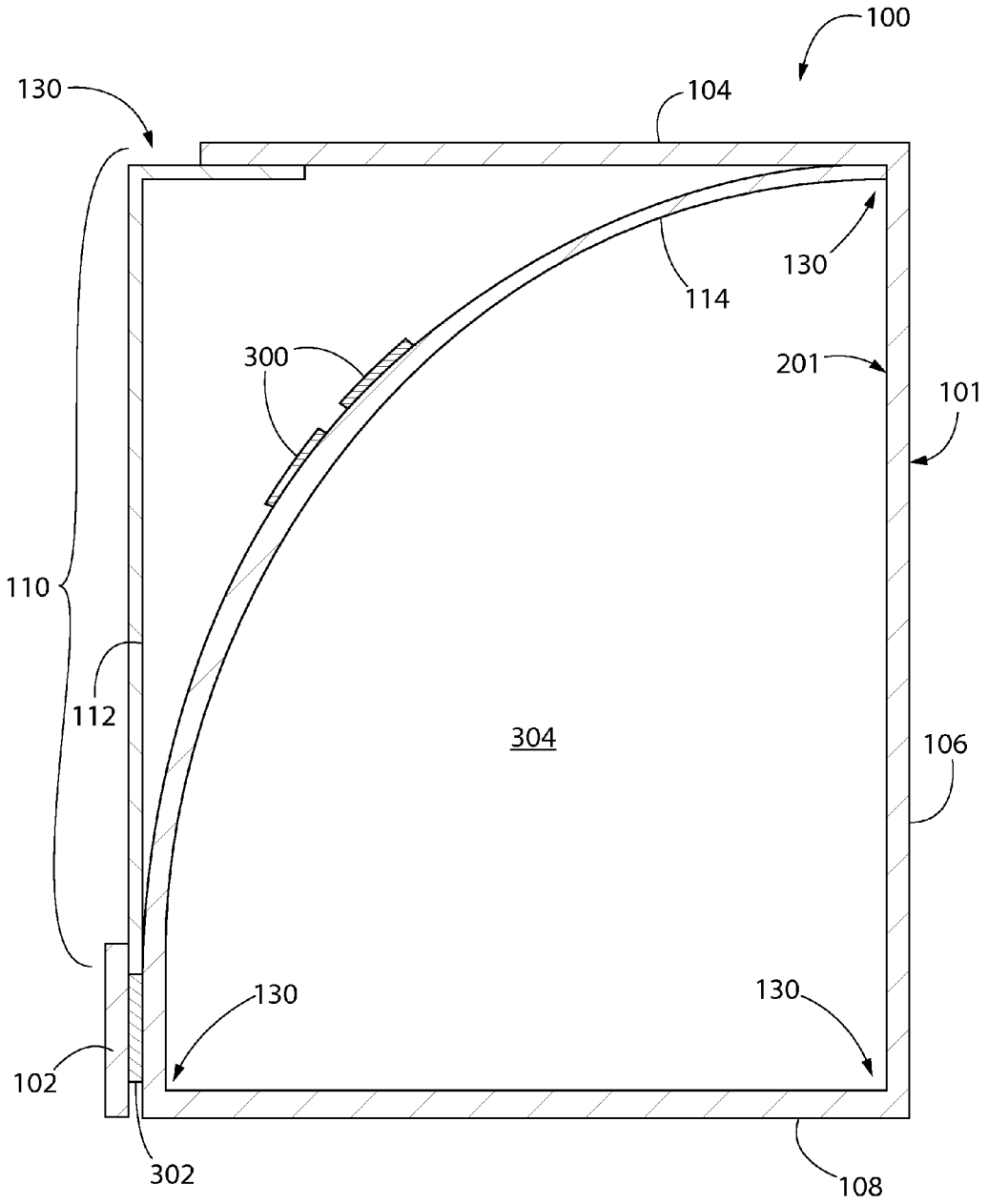
FIG. 3 is a cross section depicting the carton of FIGS. 1 and 2 after folding.

FIG. 3 is a cross section along line 3-3 of FIG. 1 after folding the carton 100. Adhesive 302 may be placed in physical contact with adhesive receiving area 126 to bond the reverse side of first major panel 102 and the display side of the display panel 114 together. If the transparent film 112 is used, some of the adhesive 302 may physically contact the transparent film 112.

As depicted in FIG. 3, after folding the carton 100, the display panel 114 may form an arc through the interior of the carton. The arcuate display panel 114 within the interior of the carton 100 can extend from a first corner of the carton 100 formed at the major fold line 130 of the fourth major panel 108 and the display panel 114, to a second corner 130 of the carton 100 formed at the major fold line 130 of the second major panel 104 and the third major panel 106. A display item 300 located on the display panel 114 within the presentation area 116 (FIG. 1) is visible through the cutout 110 in the first major panel 102 and, if optionally used, the cutout 110 in the second major panel 104 or other major panels 106, 108. In an embodiment, the display item 300 may be printed text and/or graphics, an attached item such as a toy, sticker, etc., or an attached graphic such as a decal, a photograph, or a Fresnel lens. In an embodiment, the display item may be a depiction of the product stored inside, such as a toothpaste tube. The display item may be a holographic image, such as a depiction of a toothpaste tube stored within the carton, or a depiction of another item. The display item 300 may be a combination of two or more of the foregoing items.

After folding the carton 100, the end flaps 128 at an end opposite a product insertion end 134 of the carton 100 can be folded and adhered together according to known techniques. Subsequently, a product 400 (FIG. 4) such as a toothpaste tube is inserted into the carton 100 through open end flaps 128 at the product insertion end 134 of the carton 100. During insertion of the product 400 into the product insertion end 134 of the carton 100, an angled edge 136 of the display panel 114 as depicted in FIG. 1 may reduce or prevent the likelihood of the product 400 from hanging, catching, or snagging on the display panel 114, as might occur if the display panel 114 had blunt, 90° end rather than the angled edge 136. In an embodiment, the angled edge 136 of the display panel 114 may form an angle (e.g., an average angle) of from about 20° and about 80°, or from about 30° and about 60°, or from about 40° and about 50° with the end flap fold line 132 at the product insertion end 134 of the fourth major panel 108, as measured between the end flap fold line 132 of the fourth major panel 108 at the product insertion end 134 of the carton 100 and the beginning or edge of the presentation area 116.

Figure 4:
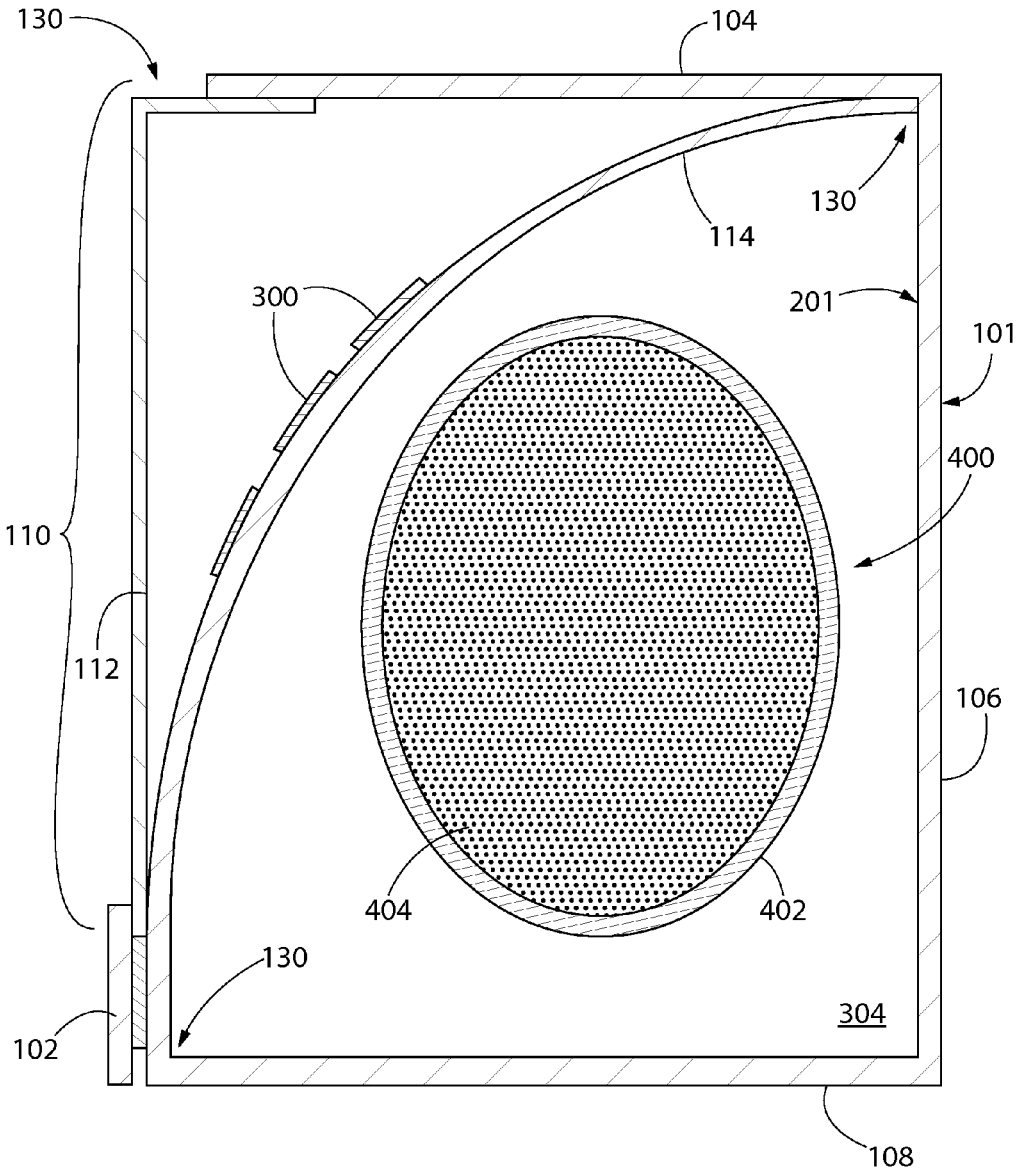
FIG. 4 is a cross section of the FIG. 3 depiction after inserting a product into the carton.

After insertion of the product 400, the end flaps 128 at the product insertion end 134 may be folded and adhered together according to known techniques to seal the product 400 within the carton 100. FIG. 4 depicts the FIG. 3 structure after insertion of the product 400 into a product storage space 304 within the carton 100. The product 400 may include, for example, a toothpaste tube having a wall 402, and toothpaste 404 sealed within the tube. In an embodiment, the product 400 sealed within the carton 100 is not visible from an exterior of the carton 100 after the carton 100 is sealed, for example, if the display panel 114 is positioned between the product storage space 304 and the cutout 110 as depicted in FIG. 3.

Figure 5:
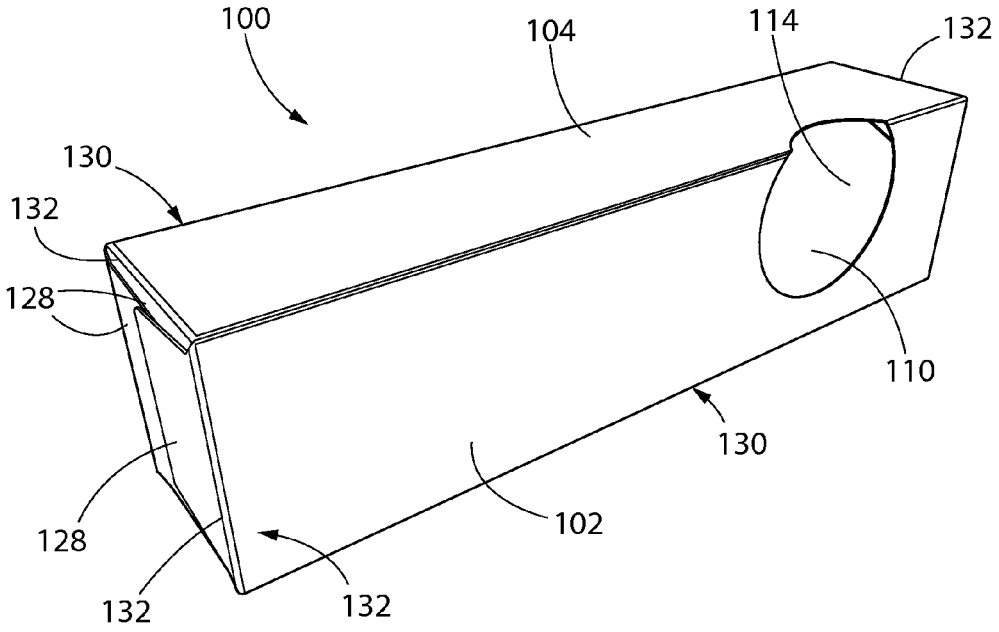
FIG. 5 is a perspective depiction of the FIG. 1 carton after sealing a product within the carton.

FIG. 5 is a perspective depiction of the carton 100 having the display panel 114 that is visible through the cutout 110 in the first major panel 102 and the second major panel 104 after folding the carton 100 and sealing a product within the carton. After folding the carton 100 as depicted in FIG. 5, each of the panels 102-108, 114 and end flaps 128 may have a substantially flat surface across the entirety of the panels 102-108 or end flaps 128 as depicted in FIGS. 1-4. Other embodiments that include a fold, ridge, or other surface irregularity across a surface of one or more of the panels 102-108 or end flaps 128 are contemplated. In the embodiment depicted in FIG. 5, the assembled carton 100 may be a six-sided rectangular cuboid having the product storage space 304 for storage of the product 400. The product storage space 304 may be defined, at least in part, by the four major panels 102-108, the display panel 114, and/or the end flaps 128.

It was found that, subsequent to folding, the carton 100 had a propensity to twist out of square into a diamond shape. Referring back to FIG. 3, this tendency to twist may result from the end of the curved display panel 114 exerting an outward force against the third major panel 106 of the carton 100. In other words, because the otherwise flat display panel 114 is curved within the carton 100, it may exert an outward, spring like force against the third major panel 106 near the corner formed by the second major panel 104 and the third major panel 106.

Figure 6:
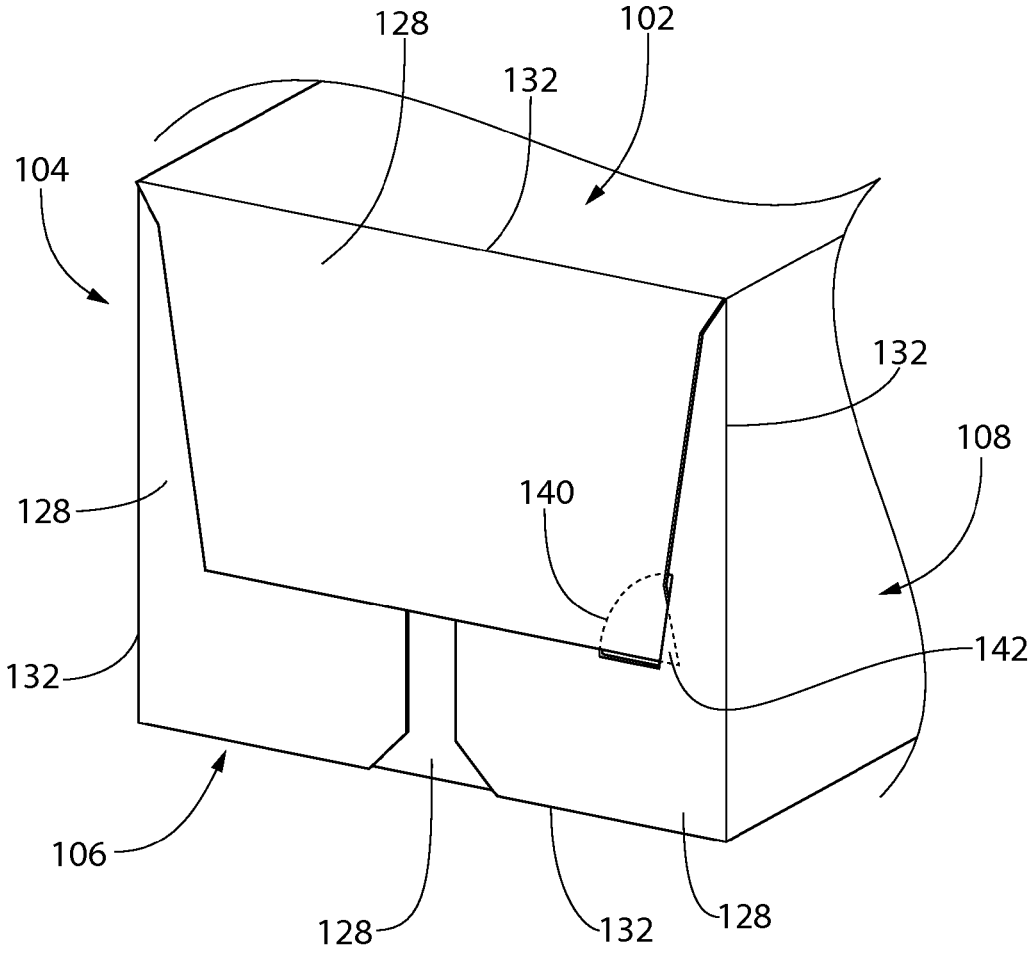
FIG. 6 is a perspective depiction an end of the FIG. 1 carton after sealing the end to reduce the effects of carton twisting.

To counteract the effects of this propensity to twist, a first end flap 128 at each end of the carton 100 may be formed with a stabilizer opening or cutout 140 as depicted in FIG. 1. The stabilizer openings 140 may be formed by removing a portion of one of the end flaps 128 at each end of the carton 100. To operate in conjunction with the stabilizer opening 140 on the first flap 128 at each end of the carton 100, a second flap 128 at each end of the carton 100 may be formed with a hook or tine 142 that protrudes from the second end flap 128, for example, as depicted in FIG. 1. In an embodiment, each hook 142 forms a pointed projection that extends or protrudes from the second end flaps 128. As depicted in FIG. 1, the stabilizer openings 140 are formed on the first end flaps that are 128 connected to the fourth major panel 108, while the hooks 142 are formed on the second end flaps 128 that are connected to the first major panel 102. During folding of the end flaps 128 at each end of the carton to form the carton 100 of FIG. 5, the two end flaps 128 connected to the second major panel 104 and the third major panel 106 are folded in first, the end flap 128 connected to the fourth major panel 108 (i.e., the end flap that includes the stabilizer opening 140) is folded in next, and the end flap 128 connected to the first major panel 102 (i.e., the end flap that includes the hook 142) is folded in last. During folding of the end flaps 128 connected to each end of the first major panel 102, and during use of the carton 100, each hook 142 at each end of the carton 100 is inserted or positioned through the stabilizer opening 140 as depicted in FIG. 6. Thus, as depicted in FIG. 6, while the majority of end flap 128 that includes the hook 142 is located in front of the end flap 128 that includes the stabilizer opening 140, the hook 142 itself is positioned through, or tucked within, the stabilizer opening 140 and is located behind the fourth major panel 108. The second end flaps 128 that include the hooks 142 thus resist the rotational pressure created by the twisting of the carton 100, and the carton 100 thereby remains in proper square or rectangular shape.

Thus an embodiment of the present teachings can include a carton for storing a product. The carton can include a plurality of major panels, wherein at least one major panel includes a cutout. The carton can further include a display panel having a presentation area that is visible through the cutout. The design of the carton may provide an interesting, attractive, and distinctive visual element of the carton that may be effective in attracting the attention and interest of a potential consumer, as well as a structure that allows one to view the presentation area 116 and/or a display item 300 located on the display panel 114.

While the text and depictions herein are used to explain various embodiments, other embodiments will be evident to one of ordinary skill in the art. For example, a carton design scheme may not require an adhesive to physically attach the first major panel 102 and the display panel 114. For example, the carton may be assembled without adhesive using one or more cut tabs and slits, or one or more mechanical fasteners. Further, other folding schemes are contemplated that are different from the folding scheme depicted and described herein, yet provide at least one display panel, where each display panel includes one or more presentation areas that are visible through the one or more cutouts in the one or more panels.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" and "overlie" mean the materials are in proximity, but possibly with one or more additional intervening materials such that physical contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

What is claimed is:

1. A carton for storing a product, comprising:

a plurality of panels, comprising:

a plurality of major panels comprising a first major panel, a second major panel separated from the first major panel by a first major fold line, a third major panel separated from the second major panel by a second major fold line, and a fourth major panel separated from the third major panel by a third major fold line; and at least one display panel separated from the fourth major panel by a fourth major fold line, wherein the plurality of major panels and the at least one display panel at least partially define a product storage space;

at least one cutout in at least one of the major panels; and a presentation area on a surface of the display panel, wherein:

the carton is configured such that the presentation area is visible through the at least one cutout after the carton is formed;

the display panel is positioned between the product storage space and the cutout; and the display panel extends from a first corner of the carton formed at the fourth major fold line that separates the fourth major panel from the display panel into a second corner of the carton formed at the second major fold line that separates the second major panel from the third major panel.

2. The carton of claim 1, wherein:

the carton further comprises an end flap connected to, and separated from, the fourth major panel by an end flap fold line;

the display panel comprises an angled edge that intersects the end flap fold line and is configured to prevent a product from catching on the display panel during insertion of the product into the carton; and the angled edge forms an average angle of from 20° to 80° with the end flap fold line measured from the end flap fold line to an edge of the presentation area.

3. The carton of claim 1, wherein the carton is a single, continuous piece of material.

4. The carton of claim 1, wherein the display panel is an arcuate display panel within an interior of the carton.

5. The carton of claim 1, further comprising a plurality of end flaps, wherein each end flap of the plurality of end flaps is separated from one of the major panels of the plurality of major panels by an end flap fold line.

6. The carton of claim 5, wherein the display panel is a curved display panel that exerts an outward, spring-like force against the third major panel, the carton further comprising:

a stabilizer opening in at least one first end flap of the plurality of end flaps; and a hook that protrudes from at least a second end flap of the plurality of end flaps, wherein the hook is positioned through the stabilizer opening after the carton is formed, and the hook and stabilizer opening are configured to counteract effects of the outward, spring-like force exerted by the curved display panel.

7. The carton of claim 1, wherein the display panel is positioned such that a product stored within the product storage space is not visible from an exterior of the carton through the cutout.

8. The carton of claim 7, further comprising a display item within the presentation area of the display panel, wherein the display item is a depiction of a product to be stored within the carton.

9. The carton of claim 1, further comprising a transparent film attached to the major panel comprising the cutout, wherein the transparent film covers the cutout.

10. A package, comprising:

a carton for storing a product, comprising:

a plurality of major panels comprising a first major panel, a second major panel separated from the first major panel by a first major fold line, a third major panel separated from the second major panel by a second major fold line, and a fourth major panel separated from the third major panel by a third major fold line, wherein the first major panel comprises a cutout;

a display panel separated from the fourth major panel by a fourth major fold line; and a presentation area on a surface of the display panel, wherein the presentation area is visible through the cutout; and a product sealed within the carton, wherein:

the display panel is positioned between the product and the cutout; and the display panel extends from a first corner of the carton formed at the fourth major fold line that separates the fourth major panel from the display panel into a second corner of the carton formed at the second major fold line that separates the second major panel from the third major panel.

11. The package of claim 10, further comprising a bonding agent that attaches the display panel to the first major panel.

12. The package of claim 10, wherein:

the carton further comprises an end flap connected to, and separated from, the fourth major panel by an end flap fold line;

the display panel comprises an angled edge that intersects the end flap fold line and is configured to prevent a product from catching on the display panel during insertion of the product into the carton; and the angled edge forms an average angle of from 20° to 80° with the end flap fold line measured from the end flap fold line to an edge of the presentation area.

13. The package of claim 10, wherein the carton is a single, continuous piece of material.

14. The package of claim 10, wherein:

the display panel is an arcuate display panel within an interior of the carton, and;

the product stored within the product storage space is not visible from an exterior of the carton through the cutout.

15. The package of claim 14, further comprising a display item within the presentation area, wherein the display item is visible through the cutout from the exterior of the carton.

16. The package of claim 15, wherein the display item is a depiction of the product stored within the carton.

17. The package of claim 10, wherein the display panel is a curved display panel that exerts an outward, spring-like force against the third major panel, the carton further comprising:

a plurality of end flaps, wherein each end flap of the plurality of end flaps is separated from one of the major panels of the plurality of major panels by an end flap fold line;

a stabilizer opening in at least one first end flap of the plurality of end flaps; and a hook that protrudes from at least a second end flap of the plurality of end flaps, wherein the hook is positioned through the stabilizer opening after the carton is formed, and the hook and stabilizer opening are configured to counteract effects of the outward, spring-like force exerted by the curved display panel.

* * * * *